US010081855B2

(12) United States Patent
Ishida et al.

(10) Patent No.: US 10,081,855 B2
(45) Date of Patent: Sep. 25, 2018

(54) HEAT-RESISTANT NI-BASE ALLOY AND METHOD OF PRODUCING THE SAME

(71) Applicants: Tanaka Kikinzoku Kogyo K.K., Tokyo (JP); Tohoku Techno Arch Co., Ltd., Sendai-shi, Miyagi (JP)

(72) Inventors: Kiyohito Ishida, Sendai (JP); Toshihiro Omori, Sendai (JP); Yutaka Sato, Sendai (JP); Kunihiro Tanaka, Hiratsuka (JP); Muneki Nakamura, Hiratsuka (JP); Koichi Sakairi, Hiratsuka (JP)

(73) Assignees: TANAKA KIKINZOKU KOGYO K.K., Chiyoda-Ku, Tokyo (JP); TOHOKU TECHNO ARCH CO., LTD., Sendai-Shi, Miyagi (JP)

( * ) Notice: Subject to any disclaimer, the term of this patent is extended or adjusted under 35 U.S.C. 154(b) by 422 days.

(21) Appl. No.: 14/774,223

(22) PCT Filed: Mar. 11, 2014

(86) PCT No.: PCT/JP2014/056242

§ 371 (c)(1),
(2) Date: Sep. 10, 2015

(87) PCT Pub. No.: WO2014/142089

PCT Pub. Date: Sep. 18, 2014

(65) Prior Publication Data

US 2016/0040276 A1 Feb. 11, 2016

(30) Foreign Application Priority Data

Mar. 12, 2013 (JP) ..... 2013-048729

(51) Int. Cl.
*C22F 1/00* (2006.01)
*C22C 30/00* (2006.01)
(Continued)

(52) U.S. Cl.
CPC ..... *C22F 1/00* (2013.01); *C22C 19/03* (2013.01); *C22C 30/00* (2013.01); *C22F 1/10* (2013.01); *C22F 1/14* (2013.01)

(58) Field of Classification Search
CPC ..... C22F 1/00; C22F 30/00
See application file for complete search history.

(56) References Cited

U.S. PATENT DOCUMENTS

2008/0206090 A1* 8/2008 Ishida ..... C22C 5/04 420/461
2010/0012235 A1 1/2010 Gleeson et al.
2017/0130310 A1* 5/2017 Ishida ..... C22F 1/10

FOREIGN PATENT DOCUMENTS

EP 1627930 A1 2/2006
EP 1983067 A1 10/2008
(Continued)

OTHER PUBLICATIONS

PCT, International Search Report PCT/JP2014/056242, dated Jun. 10, 2014.
(Continued)

*Primary Examiner* — Scott R Kastler
(74) *Attorney, Agent, or Firm* — Orrick, Herrington & Sutcliffe LLP; Joseph A. Calvaruso

(57) ABSTRACT

The present invention is a heat-resistant Ni-base alloy including a Ni—Ir—Al—W alloy having essential additive elements of Ir, Al, and W added to Ni, wherein the heat-resistant Ni-base alloy includes Ir: 5.0 to 50.0 mass %, Al: 1.0 to 8.0 mass %, and W: 5.0 to 20.0 mass %, the balance being Ni, and a γ' phase having an $L1_2$ structure disperses in a matrix as an essential strengthening phase. The heat-resistant material including the Ni-base alloy may contain one or more additive elements selected from B: 0.001 to 0.1 mass %, Co: 5.0 to 20.0 mass %, Cr: 1.0 to 25.0 mass %, Ta: 1.0 to 10.0 mass %, Nb: 1.0 to 5.0 mass %, Ti: 1.0 to 5.0
(Continued)

ALLOY A1 (1600°C × 0.5 h, 800°C × 72 h)

ALLOY A1 (1600°C × 0.5 h, 900°C × 72 h)

mass %, V: 1.0 to 5.0 mass %, and Mo: 1.0 to 5.0 mass %, or 0.001 to 0.5 mass % of C.

8 Claims, 3 Drawing Sheets

(51) Int. Cl.

| | |
|---|---|
| ***C22C 19/03*** | (2006.01) |
| ***C22F 1/10*** | (2006.01) |
| ***C22F 1/14*** | (2006.01) |

(56) References Cited

FOREIGN PATENT DOCUMENTS

| | | | |
|---|---|---|---|
| JP | 61-284545 | A | 12/1986 |
| JP | 11-310839 | A | 11/1999 |
| JP | H11-310839 | A | 11/1999 |
| JP | 4833227 | B2 | 12/2011 |
| WO | WO 2007-091576 | A1 | 8/2007 |

OTHER PUBLICATIONS

EP, Extended European Search Report concerning application No. 14763976.9, dated Oct. 12, 2016.

Zhang, et al. Modeling of phase stability of the fcc phases in the Ni—Ir—Al system using the cluster/site approximation method coupling with first-principles calculations. Acta Materialia, Jun. 2008, 56(11):2576-2584.

* cited by examiner

ALLOY A1 (1600°C × 0.5 h, 800°C × 72 h)

ALLOY A1 (1600°C × 0.5 h, 900°C × 72 h)

ALLOY A5 (1200°C × 0.4 h + 900°C × 24 h)

ALLOY A6 (1200°C × 0.4 h + 900°C × 24 h)

ALLOY A6 (1200°C × 0.4 h + 900°C × 24 h)

ALLOY A8
(1300°C × 0.2 h, 1100°C × 0.4 h + 800°C × 24 h)

ALLOY A8
(1200°C × 0.4 h + 900°C × 24 h)

ENLARGED PHOTOGRAPH

HEAT-RESISTANT NI-BASE ALLOY AND METHOD OF PRODUCING THE SAME

TECHNICAL FIELD

The present invention relates to a Ni-base heat-resistant alloy, which is suitable as a constituent material of, for example, a high-temperature member such as a jet engine and a gas turbine or a tool for friction-stirring welding (FSW) and has novel composition, and a method of producing the same. Specifically, the present invention relates to an alloy that has excellent heat resistance and oxidation resistance compared with a conventional Ni-base alloy and can maintain necessary strength even during exposure to a severe high-temperature atmosphere.

BACKGROUND ART

A Ni-base alloy, a Co-base alloy or the like is known as this type of heat-resistant alloy, but in recent years, improvement in thermal efficiency has been strongly demanded for the purpose of improving fuel economy and reducing environmental burdens of various heat engines and improvement in heat resistance of constituent materials of the heat engines has been more severely required. For this reason, development of novel heat-resistant materials alternative to the conventional Ni-base or Co-base alloy has been studied and many research reports have been published.

For example, the present inventors have disclosed an Ir—Al—W-based alloy, which is an Ir-base alloy, as a new heat-resistant alloy alternative to the Ni-base alloy (Patent Document 1). This heat-resistant alloy uses a precipitation strengthening action of a γ' phase ($Ir_3$(Al, W)) which is an intermetallic compound having an $L1_2$ structure as a strengthening mechanism of the heat-resistant alloy. Since the γ' phase exhibits inverse temperature dependence such that strength increases with a rise in temperature, the γ' phase can impart excellent high-temperature strength and high-temperature creep characteristics to the alloy. Note that the use of the strengthening action of the γ' phase is similar to that in the conventional Ni-base heat-resistant alloy.

RELATED ART DOCUMENT

Patent Document

Patent Document 1: JP 4833227 B2

SUMMARY OF THE INVENTION

Problems to be Solved by the Invention

The above-described Ir-base heat-resistant alloy according to the present inventors is satisfactory in view of improvement in high-temperature strength compared with the conventional Ni-base heat-resistant alloy, but also has problems. That is, it is pointed out that this Ir-base alloy (Ir—Al—W-based alloy) has high hardness but poor toughness, and it has been regarded that the Ir-base alloy has a tendency of becoming further brittle in particular because a brittle B2-type intermetallic compound (IrAl, hereinafter referred to as a B2 phase) remains.

Then, productivity of the Ir-base alloy is also pointed out and costs in melting and casting processes are concerned because a melting point is too high. Further, the present inventors have also found that cracks easily occur in the Ir-base alloy during casting and solidification and the production of products without defects is difficult.

The present invention has been made based on the background described above, and an object thereof is to provide a heat-resistant alloy that is excellent in high-temperature strength, particularly, toughness and also made in consideration of productivity.

Means for Solving the Problems

In order to solve the above-described problems, the present inventors have studied factors of insufficient toughness in the above-described Ir-base alloy. Then, as a result, the present inventors have considered that since in-grain strength is much higher than grain-boundary strength and the grain boundary fracture preferentially occurs in the conventional Ir-base alloy, the toughness of the entire alloy becomes insufficient. This point will be described further. Originally, Ir has high hardness but is a brittle metal, and in addition a γ' phase tends to precipitate in the grains. For this reason, it is considered that strengthening occurs only in the grains and the strengthening lacks in balance. Then, this imbalance between the in-grain strength and the grain-boundary strength is considered to be also involved in cracking during casting and solidification.

In consideration of the above-described problems of the Ir-base alloy, the present inventors have conceived the application of the Ni-base alloy in place of the alloy composed mainly of Ir. This is because the Ni-base alloy is an alloy system having good characteristics in terms of toughness apart from the high-temperature strength. Moreover, previous findings with respect to the Ni-base alloy are also abundant and it is possible to precipitate precipitates at the grain boundaries by the addition of additive elements as needed. Therefore, it is also possible to strengthen the grain-boundary strength depending on the improvement of the in-grain strength and it is also possible to make good balance between the grain-boundary strength and the in-grain strength.

Meanwhile, the Ni-base alloy has generally a melting point of about 1300 to 1400° C. and has a fundamental problem of softening because a temperature increases to approach the melting point. Moreover, factors of decrease of the high-temperature strength in the conventional Ni-base alloy are also due to the insufficient high-temperature stability such that a γ' phase ($Ni_3Al$) disappears under the high temperature.

Then, the present inventors have further studied and found that Ir and W are additive elements that increase the high-temperature stability of a matrix phase (γ phase) and the γ' phase in the Ni-base alloy. Then, the present inventors have found that use of both of a rising action of a solid phase temperature by the addition of Ir and a stability improving action of the γ' phase by the addition of Ir and W improves heat resistance of the entire alloy, and that the high-temperature strength beyond that of the conventional Ni-base alloy is exhibited while high toughness of the conventional Ni-base alloy is maintained, and have reached the present invention.

That is, the present invention is a heat-resistant Ni-base alloy including a Ni—Ir—Al—W alloy having essential additive elements of Ir, Al, and W added to Ni, wherein the heat-resistant Ni-base alloy contains Ir: 5.0 to 50.0 mass %, Al: 1.0 to 8.0 mass %, and W: 5.0 to 20.0 mass %, the balance being Ni, and a γ' phase having an $L1_2$ structure disperses in a matrix as an essential strengthening phase.

The present invention will be described below in detail. As described above, the heat-resistant alloy according to the present invention is a Ni-base alloy including Al, Ir, and W as essential additive elements. In the present invention, a γ' phase having an $L1_2$ structure is dispersed as a strengthening factor of the alloy. The γ' phase in the present invention is $(Ni, Ir)_3(Al, W)$. A precipitation strengthening action of the γ' phase is the same as in the conventional Ni-base alloy or Ir-base alloy and the γ' phase also has good high-temperature stability because of having inverse temperature dependence of strength. Then, according to the present invention, since the high-temperature stability of the γ' phase is further improved and the high-temperature strength of the alloy itself (γ phase) is also improved as described below, the Ni-base heat-resistant alloy of the present invention maintains excellent high-temperature characteristics even during exposure to a much higher high-temperature atmosphere, compared with the conventional Ni-base heat-resistant alloy.

Here, Al as an additive element is a main constituent element of the γ' phase and a component necessary for precipitation of the γ' phase. When the content of Al is less than 1.0 mass %, no γ' phase precipitates, or even when the γ' phase precipitates, the precipitation of the γ' phase does not reach a state of being able to contribute to the improvement in the high-temperature strength. On the other hand, the ratio of the γ' phase increases with an increase of Al concentration, but when Al is excessively added, the ratio of a B2-type intermetallic compound (NiAl, hereinafter may be referred to as a B2 phase) increases to make the alloy brittle and decrease the strength of the alloy. Accordingly, the upper limit of Al amount is 8.0 mass %. Note that Al also contributes to the improvement in oxidation resistance of the alloy. The amount of Al is preferably from 1.9 to 6.1 mass %.

W is a component of the Ni-base alloy which contributes to the stabilization of the γ' phase at the high temperature, and is a main constituent element of the Ni-base alloy. The stabilization of the γ' phase by the addition of W is not known in the conventional Ni-base alloy, but according to the present inventors, the addition of W can raise a γ'-phase solid solution temperature and can ensure the stability of the γ' phase at the high temperature. When W is added in an amount of less than 5.0 mass %, the improvement in the high-temperature stability of the γ' phase is not sufficient. On the other hand, excessive addition of W in an amount exceeding 25.0 mass % facilitates the formation of a phase mainly composed of W having a large specific gravity and segregation is likely to occur. Note that W also has an action of solid-solution strengthening of an alloy matrix. The amount of W is preferably from 10.0 to 20.0 mass %.

Then, Ir is an additive element which dissolves in the matrix (γ phase) in the form of a solid solution and is partially substituted by Ni of the γ'-phase, and thereby raises a solidus temperature and a solid solution temperature of the γ phase and the γ' phase, respectively, to improve heat resistance. Ir exhibits an addition effect in an amount of 5.0 mass % or more, but excessive addition of Ir increases the specific gravity of the alloy and the solidus temperature of the alloy also becomes a high temperature. Accordingly, the upper limit of Ir is 50.0 mass %. The amount of Ir is preferably from 10.0 to 45.0 mass %.

As described above, in the Ni-base alloy according to the present invention, the amounts of Al, W, and Ir to be added are in the above-described ranges to precipitate the γ' phase that can function as a strengthening phase even at the high temperature. These are the numerical ranges that the present inventors have found as a result of studies.

In the Ni-base alloy according to the present invention, proper dispersion of the γ' phase improves the high-temperature strength, but the Ni-base alloy according to the present invention does not completely eliminate the formation of other phases. That is, when Al, W, and Ir are added in the above-described ranges, a B2 phase may precipitate in addition to the γ' phase depending on the composition. Moreover, in a Ni—Al—W—Ir quaternary alloy, there is a possibility that an ε' phase of a D019 structure also precipitate. In the Ni-base alloy according to the present invention, the high-temperature strength is ensured even in the presence of these precipitates other than the γ' phase. Above all, in the Ni-base alloy according to the present invention, the precipitation of the B2 phase is relatively suppressed.

Then, in the Ni-base heat-resistant alloy according to the present invention, additional additive elements may be added in order to further improve high-temperature characteristics of the alloy and improve additional characteristics thereof. Examples of such additional additive elements include B, Co, Cr, Ta, Nb, Ti, V, and Mo.

B is an alloy component that segregates at a crystal grain boundary to strengthen the grain boundary, and contributes to improvement of high-temperature strength and ductility. The addition effect of B becomes significant in an amount of 0.001 mass % or more, but excessive addition of B is not preferable for workability and thus the upper limit of B is 0.1 mass %. The amount of B to be added is preferably from 0.005 to 0.02 mass %.

Co is effective for increasing the ratio of the γ' phase to raise strength. Co is partially substituted by Ni of the γ' phase to be a constituent element of the γ' phase. Such an effect appears when 5.0 mass % or more of Co is added, but excessive addition of Co decreases the solid solution temperature of the γ' phase and impairs the high-temperature characteristics. For this reason, the upper limit of Co content is preferably 20.0 mass %. Note that Co also has an action of improving wear resistance.

Cr is also effective for strengthening grain boundaries. Moreover, When C is added to the alloy, Cr forms carbides to precipitate the carbides in the vicinity of the grain boundaries, and thereby strengthens the grain boundaries. The addition effect of Cr appears in an amount of 1.0 mass % or more. However, when Cr is excessively added, the melting point of the alloy and the solid solution temperature of the γ' phase lower and the high-temperature characteristics are impaired. For this reason, the amount of Cr to be added is preferably 25.0 mass % or less. Note that Cr also has an action of forming a dense oxide film on the surface of the alloy and improving oxidation resistance.

Ta stabilizes the γ' phase and is also an element effective for improvement in high-temperature strength of the γ phase by solid-solution strengthening. Moreover, when C is added to the alloy, Ta can form and precipitate carbides and thus is an additive element effective for strengthening the grain boundaries. When added in an amount of 1.0 mass % or more, Ta exhibits the above-described action. Moreover, since excessive addition causes formation of a harmful phase or a decrease of the melting point, the upper limit of Ta is preferably 10.0 mass %.

Moreover, Nb, Ti, V, and Mo are also additive elements effective for stabilization of the γ' phase and improvement in high-temperature strength by solid-solution strengthening of a matrix. Nb, Ti, V, and Mo are preferably added in an amount of 1.0 to 5.0 mass %.

As described above, additive elements of B, Co, Cr, Ta, Nb, Ti, V, and Mo can segregate in the vicinity of the grain boundary to improve grain-boundary strength and at the same time improve strength by stabilizing the γ' phase. As described above, Co, Cr, Ta, Nb, Ti, V, and Mo also act as constituent elements of the γ' phase. A crystal structure of the γ' phase at this time is an $L1_2$ structure similar to the γ' phase of a Ni—Ir—Al—W quaternary alloy without additive elements and is expressed as $(Ni, X)_3(Al, W, Z)$. Here, X is Ir or Co, and Z is Ta, Cr, Nb, Ti, V, or Mo.

Then, an example of a further effective additive element includes C. C forms carbides together with metal elements in the alloy to precipitate the carbides and thereby improves high-temperature strength and ductility. Such an effect appears when 0.001 mass % or more of C is added, but since excessive addition of C is not preferable for workability or toughness, the upper limit of C content is 0.5 mass %. The amount of C to be added is preferably 0.01 to 0.2 mass %. Note that C has a great significance for the formation of the carbides as described above, and in addition, is an element effective for strengthening of the grain boundaries by segregation, in a similar manner to B.

In the Ni-base alloy according to the present invention, the precipitates (carbides) are easily controlled when the Ni-base alloy is diversified by the above-described plurality of additive elements. Then, it is possible to obtain the grain-boundary strength appropriate for in-grain strength which is strengthened by the γ' phase.

Note that an intermetallic compound other than the γ' phase may precipitate even when these additive elements are added to the Ni-base alloy. This intermetallic compound is a B2-type intermetallic compound ((Ni, X)(Al, W, Z)) (definitions of X and Z are the same as described above) having a crystal structure similar to the B2 phase in the Ni—Ir—Al—W quaternary alloy without additive elements. Even in this case, when each of the constituent elements is within the suitable range and the γ' phase is precipitated, the high-temperature strength is ensured even in the presence of the precipitates other than the γ' phase.

A grain size of the γ' phase in the Ni-base heat-resistant alloy according to the present invention described above is preferably 10 nm to 1 μm. Moreover, the precipitation amount of the γ' phase is preferably 20 to 85% by volume in total with respect to the entire alloy. The precipitation strengthening action can be obtained in the precipitates of 10 nm or more, but rather decreases in coarse precipitates of more than 1 μm. Moreover, in order to obtain a sufficient precipitation strengthening action, the precipitation amount of 20% or more by volume is necessary, but there is a concern of the ductility decrease in the excessive precipitation amount of more than 85% by volume. In order to obtain the suitable grain size and precipitation amount, an aging treatment in steps is preferably performed at a predetermined temperature range in a production method to be described below.

In production of the Ni-base alloy according to the present invention, the Ni-base alloy can be produced by any method of an ordinary melting and casting method, unidirectional solidification, forging, and a single-crystal method. Then, the Ni alloy to be produced by various methods is subjected to an aging heat treatment and thereby the γ' phase can be precipitated. In this aging heat treatment, the Ni alloy is heated to the temperature range of 700 to 1300° C. Preferably, the temperature range is 750 to 1200° C. In addition, heating time at this time is preferably from 30 minutes to 72 hours. Note that this heat treatment may be performed several times, for example, in a manner of heating for 4 hours at 1100° C. and further heating for 24 hours at 900° C.

Moreover, prior to the aging heat treatment, a heat treatment for homogenization is preferably performed. In this homogenization heat treatment, the Ni alloy to be produced by various methods is heated to the temperature range of 1100 to 1800° C. Preferably, the Ni alloy is heated in the range of 1200 to 1600° C. Heating time at this time is preferably from 30 minutes to 72 hours.

Advantageous Effects of the Invention

The Ni-base alloy according to the present invention has significantly excellent high-temperature characteristics such as high-temperature strength compared with the Ni-base alloy which has been conventionally used. The Ni-base alloy according to the present invention has strength/ductility balance beyond the Ir-base alloy which the present inventors have developed as a heat-resistant alloy alternative to the conventional Ni-base alloy. Then, the Ni-base alloy according to the present invention is also excellent in productivity and does not cause cracks in the solidification process during the casting. Moreover, in the Ni-base alloy according to the present invention, the melting point is also suppressed to a relatively low temperature, a lost-wax method is also applicable, and the molding excellent in dimensional accuracy is also possible.

MODE FOR CARRYING OUT THE INVENTION

Figure 1:
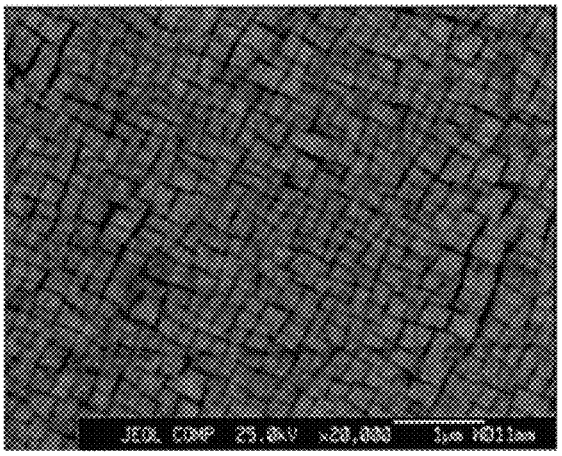
FIG. 1 shows a reflected electron image of alloy A1 according to a first embodiment.
Figure 1:
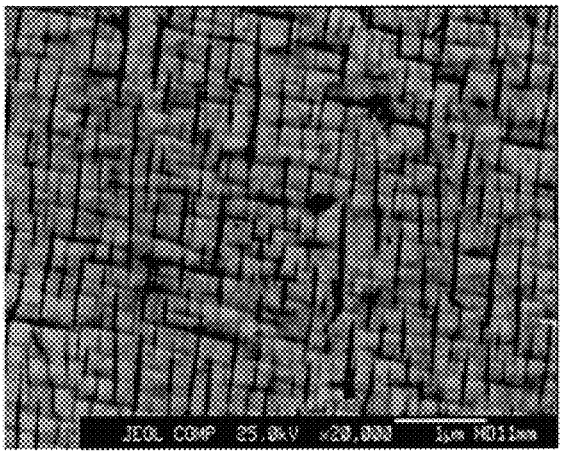

Suitable examples of the present invention will be described below.

First Embodiment

In this embodiment, a Ni—Ir—Al—W alloy serving as basic composition was produced while the composition was adjusted. The Ni-base alloy was melted by arc melting in an inert gas atmosphere and cast into an alloy ingot. A Ni—Ir—Al—W quaternary alloy produced in this embodiment is indicated in Table 1.

TABLE 1

| | Alloy | Alloy composition (mass %) | | | | | | | | |
|---|---|---|---|---|---|---|---|---|---|---|
| | No. | Ni | Ir | Al | W | Co | Cr | Ta | C | B |
| Example | A1 | 40.52 | 44.24 | 4.66 | 10.58 | — | — | — | — | — |
| | A2 | 38.78 | 42.33 | 3.71 | 15.18 | — | — | — | — | — |
| | A3 | 55.86 | 26.14 | 5.5 | 12.5 | — | — | — | — | — |
| | A4 | 65.83 | 14.37 | 6.05 | 13.75 | — | — | — | — | — |
| Comparative Example | B1 | 20.67 | 67.68 | 3.56 | 8.09 | — | — | — | — | — |
| | B2 | 78.01 | — | 6.72 | 15.27 | — | — | — | — | — |

Test pieces were cut out from the alloy ingot having each kind of composition described above and were subjected to a heat treatment while conditions were adjusted, and various studies were performed.

[Measurement of γ'-Phase Solid Solution Temperature and Solidus Temperature]

A heat treatment was performed on alloys A1 to A3, B1, and B2 indicated in Table 1, and γ'-phase solid solution temperatures and solidus temperatures of the alloys were measured. The solid solution temperatures and the solidus temperatures were measured by a differential scanning calorimeter (DSC). These studies were also performed for comparison on a Waspaloy alloy (56% Ni-19% Cr-13% Co-4% Mo-3% Ti-1.3% Al) known as a Ni-base heat-resistant material. The results are indicated in Table 2.

TABLE 2

| | | Heat treatment | | Temperature/° C. | |
|---|---|---|---|---|---|
| Test No. | Alloy No. | Homogenization treatment | Aging treatment | γ'-phase solid solution temperature | Solidus temperature |
| 1 | A1 | 1600° C. × 0.5 h + AC | 900° C. × 72 h + WQ | 1395 | 1500 or more |
| 2 | A2 | 1600° C. × 0.5 h + AC | | 1385 | 1500 or more |
| 3 | A3 | 1550° C. × 72 h + AC | | 1348 | 1449 |
| 4 | B1 | 1900° C. × 0.5 h + AC | | 1500 or more | 1500 or more |
| 5 | B2 | 1300° C. × 0.5 h + AC | | 1309 | 1436 |
| 6 | Waspaloy | — | — | 1056 | 1313 |

While each of alloys A1 to A3, B1, and B2 is a Ni alloy to which W is added, the Waspaloy alloy is a Ni alloy that does not contain W. The γ'-phase solid solution temperature has significantly risen in alloys A1 to A3, B1, and B2 compared with the Waspaloy alloy, and it can be confirmed that the addition of W has an effect of raising the high-temperature stability of the γ' phase. Meanwhile, each of alloys A1 to A3 (examples) is an alloy to which Ir is further added, and both of the γ'-phase solid solution temperature and the solidus temperature have risen compared with alloy B2 (comparative example). It is considered that this is because the addition of Ir has an effect of raising both of the solidus temperature and the γ'-phase solid solution temperature. As a result, it can be confirmed that the simultaneous addition of Ir and W is suitable. However, as can be seen from the results of alloy B1, when the amount of Ir to be added increases, both of the solidus temperature and the γ'-phase solid solution temperature become 1500° C. or more, and the solidus temperature considerably increases.

FIG. 1 is a reflected electron image when alloy A1 is observed with SEM. This alloy had a two-phase structure of γ/γ' even after being subjected to any heat treatment and the γ' phase of 100 to 300 nm was precipitated. The volume fraction of the γ' phase was about 80%.

[Hardness Measurement]

Various heat treatments were performed on alloys A1 to A4 and B2 indicated in Table 1, and hardness was measured. The hardness was measured by a Vickers test (load of 500 gf, pressing time of 15 seconds, and room temperature). The results are indicated in Table 3.

TABLE 3

| | | Heat treatment | | |
|---|---|---|---|---|
| Test No. | Alloy No. | Homogenization treatment | Aging treatment | Hardness/Hv |
| 7 | A1 | 1600° C. × 1 h + AC | 1300° C. × 72 h + WQ | 408 |
| 8 | | | 1100° C. × 72 h + WQ | 422 |
| 9 | | | 1000° C. × 72 h + WQ | 509 |
| 10 | | | 900° C. × 72 h + WQ | 551 |
| 11 | | | 800° C. × 72 h + WQ | 559 |
| 12 | | | 700° C. × 72 h + WQ | 537 |
| 13 | A2 | 1600° C. × 0.5 h + AC | 1300° C. × 72 h + WQ | 421 |
| 14 | | | 1100° C. × 72 h + WQ | 412 |
| 15 | | | 1000° C. × 72 h + WQ | 470 |
| 16 | | | 900° C. × 72 h + WQ | 492 |
| 17 | | | 800° C. × 72 h + WQ | 500 |
| 18 | | | 700° C. × 72 h + WQ | 473 |
| 19 | A3 | 1550° C. × 0.5 h + AC | 800° C. × 72 h + WQ | 440 |
| 20 | A4 | 1300° C. × 72 h + AC | 800° C. × 72 h + WQ | 394 |
| 21 | B2 | 1300° C. × 72 h + AC | 800° C. × 72 h + WQ | 341 |

From the viewpoint of hardness at room temperature, alloys A1 to A3 have a hardness exceeding 400 Hv and alloy A4 also has a hardness close to 400 Hv. When compared with alloy B2 (comparative example) that does not contain Ir, it is observed in alloys A1 to A4 that the addition of Ir had an effect of raising the strength of the γ'-phase.

[High-Temperature Oxidation Characteristics]

Various heat treatments were performed on alloys A1, A3, A4, and B2 indicated in Table 1, and high-temperature oxidation characteristics were evaluated. A high-temperature oxidation test was performed in such a manner that test pieces were cut out to the dimension of 2 mm×2 mm×2 mm and were heat-treated at 1200° C. for 1, 4, 24 hours in air and subsequent weight change was measured. The results are indicated in Table 4.

TABLE 4

| | | Heat treatment | | Mass change/mg | | |
|---|---|---|---|---|---|---|
| Test No. | Alloy No. | Homogenization treatment | Aging treatment | 1 hour | 4 hours | 24 hours |
| 22 | A1 | 1600° C. × 1 h + AC | 800° C. × 72 h + WQ | 1.2 | 1.9 | 4.2 |

TABLE 4-continued

| Test No. | Alloy No. | Heat treatment: Homogenization treatment | Heat treatment: Aging treatment | Mass change/mg: 1 hour | 4 hours | 24 hours |
|---|---|---|---|---|---|---|
| 23 | A3 | 1550° C. × 0.5 h + AC | 800° C. × 72 h + WQ | 0.7 | 1.6 | 2.3 |
| 24 | A4 | 1300° C. × 72 h + AC | 800° C. × 72 h + WQ | 0.5 | 0.8 | −9.0 |
| 25 | B2 | 1300° C. × 72 h + AC | 800° C. × 72 h + WQ | −0.2 | −0.9 | −12.1 |

In the above-described oxidation resistance measurement, it was confirmed that while the weight of alloy B2 (comparative example) reduced due to an oxide film peeled off after exposure at 1200° C., the weights of alloys A1, A3, and A4 each containing Ir increased due to slight oxidation without oxide films peeled off due to active oxidation as in alloy B2, and alloys A1, A3, and A4 are excellent in oxidation resistance.

[High-Temperature Strength Characteristics]

Heat treatments were performed on alloys A1 and A3 indicated in Table 1, and subsequently high-temperature strength was evaluated. Here, a high-temperature compression test was performed to create a stress-strain curve and 0.2% proof stress was determined based on the stress-strain curve. The results are indicated in Table 5.

TABLE 5

| Test No. | Alloy No. | Heat treatment: Homogenization treatment | Heat treatment: Aging treatment | Temperature: 25° C. | 1000° C. | 1200° C. |
|---|---|---|---|---|---|---|
| 26 | A1 | 1600° C. × 1 h + AC | 800° C. × 72 h + WQ | 1140 MPa | 700 MPa | 495 MPa |
| 27 | A3 | 1550° C. × 0.5 h + AC | 800° C. × 72 h + WQ | 902 MPa | 570 MPa | 447 MPa |

It can be seen from Table 5 that the Ni-base alloy according to each example has sufficient strength even at a high temperature (1000° C., 1200° C.). With respect to the above-described values, Mar-M247, which is a known Ni-base super alloy, has high-temperature strength of 380 MPa (1000° C.) or 50 MPa (1200° C.). Moreover, the Waspaloy alloy has high-temperature strength of 220 MPa (1000° C.). Accordingly, it can be said that the Ni-base alloy according to each of examples has much higher high-temperature strength than the conventional Ni-base heat-resistant alloy.

Second Embodiment

In this embodiment, a Ni-base alloy was produced with various additive elements (B, C, Co, Cr, and Ta) added. As in the first embodiment, the Ni-base alloy was produced by arc melting in an inert gas atmosphere and cast into an alloy ingot. A Ni—Ir—Al—W-based alloy produced in this embodiment is indicated in Table 6.

TABLE 6

| | Alloy No. | Alloy composition (mass %): Ni | Ir | Al | W | Co | Cr | Ta | C | B |
|---|---|---|---|---|---|---|---|---|---|---|
| Example | A5 | 47.88 | 13.84 | 4.47 | 13.23 | 8.48 | 6.74 | 5.21 | 0.13 | 0.12 |
| | A6 | 39.83 | 25.25 | 4.08 | 12.07 | 7.74 | 6.15 | 4.75 | 0.12 | 0.11 |
| | A7 | 27.33 | 42.96 | 3.47 | 10.27 | 6.59 | 5.23 | 4.04 | 0.1 | 0.01 |
| | A8 | 37.77 | 24.96 | 4.38 | 14.32 | 7.65 | 6.08 | 4.7 | 0.13 | 0.11 |
| | A9 | 24.75 | 39.61 | 1.95 | 18.94 | 6.07 | 4.82 | 3.73 | 0.12 | 0.009 |
| | A10 | 40.4 | 44.3 | 4.7 | 8.5 | — | — | 2.1 | — | — |
| | A11 | 40.4 | 44.3 | 4.7 | 6.4 | — | — | 4.2 | — | — |
| | A12 | 40.58 | 44.16 | 4.66 | 10.59 | — | — | — | — | 0.007 |
| | A13 | 41.00 | 43.51 | 4.71 | 10.7 | — | — | — | 0.07 | 0.008 |
| Comparative Example | B3 | 57.67 | — | 4.94 | 14.64 | 9.39 | 7.45 | 5.76 | 0.14 | 0.014 |

Then, also in this embodiment, test pieces were cut out from the alloy ingot having each kind of composition described above and were subjected to a heat treatment while conditions were adjusted, and various studies were performed.

[Measurement of γ'-Phase Solid Solution Temperature and Solidus Temperature]

As in the first embodiment, γ'-phase solid solution temperatures and solidus temperatures of Ni-base alloys A5 to A9 indicated in Table 6 were measured. The results are indicated in Table 7.

TABLE 7

| Test No. | Alloy No. | Heat treatment: Homogenization treatment | Heat treatment: Aging treatment | Temperature/° C.: γ'-phase solid solution temperature | Temperature/° C.: Solidus temperature |
|---|---|---|---|---|---|
| 28 | A5 | — | 1300° C. × 2 h + WQ | 1242 | 1367 |
| 29 | A6 | | | 1273 | 1393 |
| 30 | A7 | | | 1362 | 1477 |
| 31 | A8 | | | 1280 | 1387 |
| 32 | A9 | | | 1260 | 1500 or more |
| 33 | B3 | | | 1230 | 1363 |

[Hardness Measurement]

Heat treatments were performed on Ni-base alloys A5 to A11 indicated in Table 6, and subsequently hardness was measured. Conditions of the hardness measurement are similar to those in the first embodiment. The results are indicated in Table 8.

TABLE 8

| Test No. | Alloy No. | Heat treatment: Homogenization treatment | Heat treatment: Aging treatment | Hardness/Hv |
|---|---|---|---|---|
| 34 | A5 | 1200° C. × 4 h + AC | 900° C. × 24 h + AC | 463 |
| 35 | A6 | | | 483 |
| 36 | A7 | | | 478 |
| 37 | A8 | | | 501 |
| 38 | A9 | | | 623 |
| 39 | A10 | 1600° C. × 0.5 h + AC | 900° C. × 72 h + WQ | 547 |
| 40 | | | 800° C. × 72 h + WQ | 581 |
| 41 | | | 700° C. × 72 h + WQ | 557 |
| 42 | A11 | | 900° C. × 72 h + WQ | 566 |
| 43 | | | 800° C. × 72 h + WQ | 585 |
| 44 | | | 700° C. × 72 h + WQ | 562 |
| 45 | B3 | 1200° C. × 4 h + AC | 900° C. × 24 h + AC | 429 |

[High-Temperature Strength Characteristics]

Heat treatments were performed on Ni-base alloys A8, A12, and A13 indicated in Table 6, and subsequently a high-temperature compression test was performed to determine 0.2% proof stress. The results are indicated in Table 9.

TABLE 9

| Test No. | Alloy No. | Heat treatment: Homogenization treatment | Heat treatment: Aging treatment | Temperature: 25° C. | Temperature: 1000° C. |
|---|---|---|---|---|---|
| 46 | A8 | 1300° C. × 2 h + AC | 1100° C. × 4 h + AC + 800° C. × 24 h + AC | 1080 MPa | 700 MPa |
| 47 | A12 | 1450° C. × 4 h + AC | 1000° C. × 45 h + WQ | 640 MPa | 430 MPa |
| 48 | A13 | | | 740 MPa | 520 MPa |

From the above results, also in the Ni—Ir—Al—W-based alloy to which various additive elements are added, the improvement in the high-temperature stability of the γ' phase and the rising of the solidus temperature can be seen and the effect of the γ' phase of raising the strength can be confirmed. Note that there was a tendency that the γ'-phase solid solution temperature and the solidus temperature are lower but the hardness increases in the Ni alloy according to the present invention compared with the alloy (first embodiment) without the additive elements. It is considered that this is because of influence on the γ'-phase stabilization, the carbide precipitation, and the solid-solution strengthening by each of the additive elements. It is understood that relatively high hardness is also obtained due to the additive elements in alloy B3 (comparative example), but higher hardness is obtained by adding Ir at the same time as in alloys A5 to A9. Then, it was able to be confirmed to exhibit excellent results in terms of the high-temperature strength.

Figure 2:
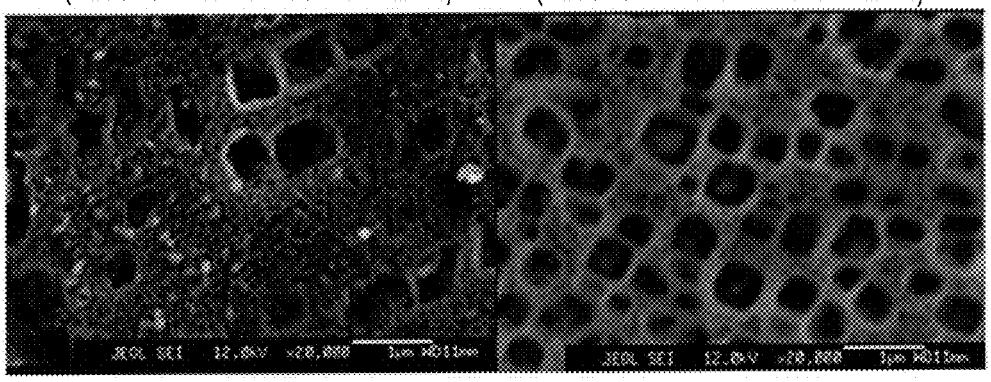
FIG. 2 shows secondary electron images of alloys A5 and A6 according to a second embodiment.
Figure 3:
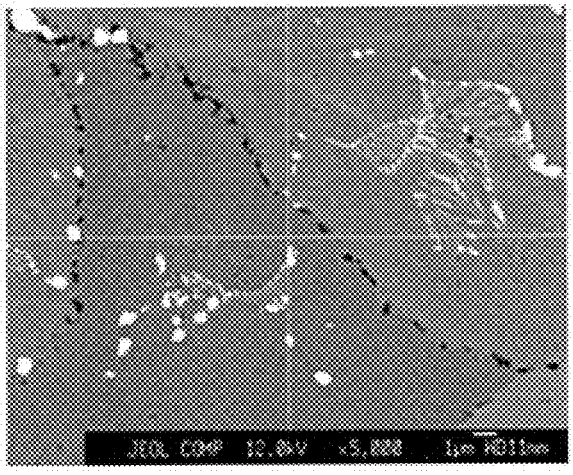
FIG. 3 shows a reflected electron image of alloy A6 according to the second embodiment.

FIG. 2 illustrates a secondary electron image when alloys A5 and A6 are observed by SEM. Prior to the SEM observation, these alloys are subjected to an aging treatment in two steps (1200° C.×4 hours and 900° C.×24 hours). As a result of the aging treatment in the two steps, γ' phases of different sizes are precipitated. In these γ' phases, fine γ' phases of 10 to 50 nm are precipitated between large-sized γ' phases of 300 to 800 nm. The volume fraction of the γ' phases in each of the alloys was about 45% in alloy A5 and about 50% in alloy A6. Moreover, FIG. 3 is a reflected electron image of alloy A6 subjected to the same heat treatment. It is confirmed by EPMA analysis that black contrast of grain boundaries in the photograph is an $M_{23}C_6$ carbide. Then, precipitation phases of white contrast are also confirmed in the grains, but this is estimated to be an MC carbide.

Figure 4:
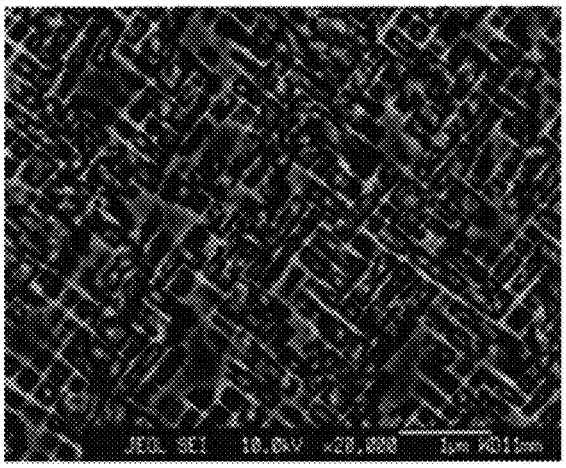
FIG. 4 shows a secondary electron image of alloy A8 according to the second embodiment.
Figure 5:
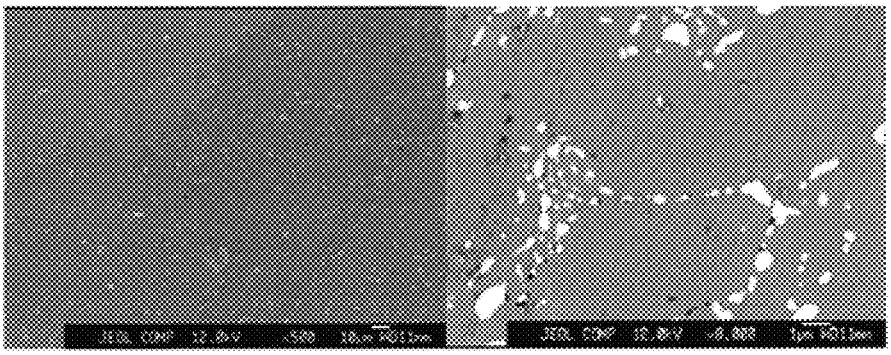
FIG. 5 shows a reflected electron image of alloy A8 according to the second embodiment.

Further, FIG. 4 shows a secondary electron image when alloy A8 is observed with SEM, and in this alloy, γ' phases of 100 to 200 nm are precipitated and the γ'-phase volume fraction was about 65%. Moreover, FIG. 5 is a reflected electron image of alloy A8. Precipitates of white contrast are observed around grain boundaries, but these precipitates are obtained by precipitation and dispersion of $M_{23}C_6$ carbides and MC carbides.

INDUSTRIAL APPLICABILITY

The present invention is a Ni alloy which is excellent in the high-temperature characteristics such as the high-temperature strength and the oxidation resistance compared with the conventional Ni-base heat-resistant alloy. The present invention is suitable for members of a gas turbine, an aircraft engine, a chemical plant, an automobile engine such as a turbocharger rotor, and a high-temperature furnace, for example.

Moreover, an example of application of the heat-resistant alloy includes application to a tool for friction-stirring welding (FSW) in recent years. The friction-stirring welding is a welding method of pressing the tool between workpieces to be welded and moving the tool in a welding direction while rotating the tool at a high speed. This welding method permits welding of the tool and the workpieces to be welded by frictional heat and solid-phase stirring therebetween, and the temperature of the tool considerably increases. The conventional Ni-base alloy can be applied to the welding of a relatively low melting point metal such as aluminum, but could not be used for a high melting point material such as a steel material, a titanium alloy, a nickel-base alloy, a zirconium-base alloy from the viewpoint of the high-temperature strength. The Ni-base alloy according to the present invention can be applied as a constituent material of a tool for friction-stirring welding, which is used to weld the above-described high melting point material, because of the improvement of the high-temperature strength.

The invention claimed is:

1. A heat-resistant Ni-base alloy comprising a Ni—Ir—Al—W alloy having essential additive elements of Ir, Al, and W added to Ni, wherein the heat-resistant Ni-base alloy contains Ir: 5.0 to 45.0 mass %, Al: 1.0 to 8.0 mass %, and W: 5.0 to 20.0 mass %, the balance being Ni, and a γ' phase having an $L1_2$ structure precipitates and disperses in a matrix as an essential strengthening phase.

2. The heat-resistant Ni-base alloy according to claim 1, wherein the alloy contains one or more additive elements selected from the following Group I:

Group I:
B: 0.001 to 0.1 mass %,
Co: 5.0 to 20.0 mass %,
Cr: 1.0 to 25.0 mass %,
Ta: 1.0 to 10.0 mass %,
Nb: 1.0 to 5.0 mass %,
Ti: 1.0 to 5.0 mass %,
V: 1.0 to 5.0 mass %, and
Mo: 1.0 to 5.0 mass %.

3. The heat-resistant Ni-base alloy according to claim 1, wherein the alloy further contains 0.001 to 0.5 mass % of C and carbides are precipitate and disperse.

4. A method of producing a heat-resistant Ni-base alloy, comprising:

performing an aging heat treatment on the Ni-base alloy having the composition according to claim 1, at a temperature range of 700 to 1300° C.; and precipitating at least a γ' phase having an $L1_2$ structure as precipitates.

5. The method of producing a heat-resistant Ni-base alloy according to claim 4, comprising performing a homogenization heat treatment on the Ni-base alloy at a temperature range of 1100 to 1800° C., prior to the aging heat treatment.

6. The heat-resistant Ni-base alloy according to claim 2, wherein the alloy further contains 0.001 to 0.5 mass % of C and carbides are precipitate and disperse.

7. A method of producing a heat-resistant Ni-base alloy, comprising:

performing an aging heat treatment on the Ni-base alloy having the composition according to claim 2, at a temperature range of 700 to 1300° C.; and precipitating at least a γ' phase having an $L1_2$ structure as precipitates.

8. A method of producing a heat-resistant Ni-base alloy, comprising:

performing an aging heat treatment on the Ni-base alloy having the composition according to claim 3, at a temperature range of 700 to 1300° C.; and precipitating at least a γ' phase having an $L1_2$ structure as precipitates.

* * * * *